United States Patent [19]

Rias et al.

[11] Patent Number: 4,948,660

[45] Date of Patent: Aug. 14, 1990

[54] HEAT AND SOUND INSULATING PANEL

[75] Inventors: Jean-Claude Rias, Villenes Sur Seine; Roger Zinzius, Givry, both of France

[73] Assignee: Isover Saint-Gobain, Aubervilliers, France

[21] Appl. No.: 304,561

[22] Filed: Feb. 1, 1989

[30] Foreign Application Priority Data

Feb. 1, 1988 [FR] France ..... 88 01107

[51] Int. Cl.[5] ..... B27N 9/00; B32B 5/26

[52] U.S. Cl. ..... 428/285; 428/195; 428/200; 428/209; 428/290; 428/426; 428/433; 428/441; 428/461; 428/523; 428/920; 181/290

[58] Field of Search ..... 428/426, 920, 441, 433, 428/461, 523, 195, 209, 210, 339, 340, 200, 457, 284, 285; 181/290

[56] References Cited

U.S. PATENT DOCUMENTS

| | | | |
|---|---|---|---|
| 3,560,320 | 2/1971 | Letteron | 428/441 |
| 3,620,906 | 11/1971 | Hannes | 428/441 |
| 4,348,450 | 9/1982 | Shaw | 428/182 |
| 4,358,503 | 11/1982 | Homeyer | 428/285 |
| 4,447,490 | 5/1984 | Ventker | 428/920 |
| 4,567,092 | 1/1986 | Catrain et al. | 428/246 |
| 4,756,955 | 7/1988 | Rias | 428/281 |
| 4,812,355 | 3/1989 | Yokoyama | 428/441 |

*Primary Examiner*—Jose Dees
*Assistant Examiner*—Amy Hulina
*Attorney, Agent, or Firm*—Oblon, Spivak, McClelland, Maier & Neustadt

[57] ABSTRACT

A heat and sound insulating panel comprises an insulating layer of mineral fibers bonded by a synthetic resin and surfacing layer consisting of a sheet of glass fibers. Between these two layers there is a heat-sealing film, for example of polyethylene, having a low level of steam permeability, having adherent qualities when heated, and an aluminum film of a thickness less than or equal to 9 microns, the aluminum film being glued to the glass sheet.

6 Claims, 1 Drawing Sheet

HEAT AND SOUND INSULATING PANEL

BACKGROUND OF THE INVENTION

1. Field of the Invention

The invention relates to a heat and sound insulating panel intended particularly for the dry insulation of under-roof spaces, or for making up suspended ceilings particularly for industrial buildings or buildings intended for public use, such as business premises, concert halls, theatres, etc.

2. Background of the Prior Art

A heat and sound insulating panel normally consists of a basic layer of mineral fibers, for example glass fibers, provided on the visible surface side with a surfacing layer which gives it a decorative finished appearance. This surfacing layer is for example a film of polyvinyl chloride, or a sheet of glass fibers obtained preferably by the wet method or a film of aluminum possibly backed with kraft paper.

From the point of view of decorative appearance, glass sheet surfaces are markedly superior to those of other materials because they can be painted and blend in with the decor. But these glass sheet surfacings have the serious drawback of being permeable to air and to steam. Behind such a panel—for example in the spaced comprised between the ceiling slab of the floor above and the suspended ceiling—ambient pressure is generally different from that which is obtained in the room. Consequently, there is an exchange of gases through the panel consisting of two porous layers which become veritable dust filters and the panels quickly become blackened.

Impermeable surfacings of the aluminum film type cannot be painted and are therefore more especially suitable for factory sheds where the finished appearance is of less importance. Furthermore, they at least partly reflect the sound waves which therefore cannot be deadened by the basic layer of glass fibers. Sound insulation is therefore considerably lessened.

The object of the present invention is a heat and sound insulating panel which combines good aesthetic quality with good heat and sound insulating performance and simple maintenance.

SUMMARY OF THE INVENTION

According to the invention, this problem is resolved by a heat and sound insulating panel which comprises an insulating layer of mineral fibers, particularly glass fibers, bonded by a synthetic resin and a surfacing layer consisting of a sheet of glass fibers, characterized in that between these two layers there is provided a heat-sealing film of low permeability to air and steam, and which becomes adherent when heated, and an aluminum film of a thickness less than or equal to 9 microns, the aluminum film being adhered to the glass sheet.

DETAILED DESCRIPTION OF THE INVENTION

Figure 1:
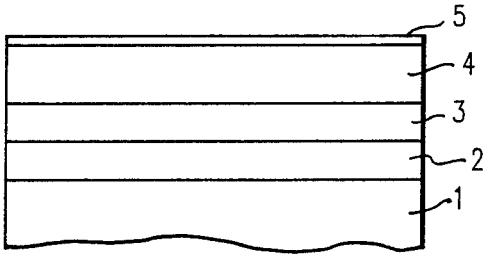
FIG. 1 is a side view of the inventive laminated panel of the claimed invention.

The outer layer of such a panel consists of a sheet of glass fibers 4 preferably obtained by the wet method, according to a technique similar to the techniques of paper manufacture, made from glass fibers which are drawn continuously and then cut (fibers which are referred to as textile fibers). The appearance is strongly reminiscent of that of a furnishing fabric. Furthermore, a sheet of glass fibers may be dyed to the chosen colors.

The insulating layer 1 consists of mineral fibers preferably produced by centrifugation and drawing by means of streams of high velocity and high temperature gases according to the fiber producing method described in EP No. 91,866, employing a conventional technique for the manufacture of insulting mats; an organic binder being sprayed directly onto the fibers in the fiber producing hood. As an organic binder, any type of resin known in the mineral fibers industry may be used, particularly phenolformaldehyde resins, modified or not with urea or melamine resins having improved fire resistance. The thickness of the insulating layer is generally between 10 and 100 mm while its basic weight is between 700 and 2500 g/m$^2$, for glass fibers, which produces very lightweight panels of which the dimensions (for example 600×1200 mm) make for simple and rapid fitting.

Between these two porous layers which are highly permeable to air and steam, there is according to the invention an associated heat-sealing film 2 of low permeability to air and above all to steam and aluminum film 3 of a thickness less than or equal to 9 microns, glued to the surfacing layer. The aluminum film ensures reduced steam permeability of the panel. However, the thickness of the aluminum film must be limited to not more than 9 microns, or a substantial loss of soundproofing qualities occurs. However, the impermeability of the aluminum film in respect of steam cannot be regarded as sufficient unless its thickness exceeds 12 microns. The problem posed by the partially porous nature of the aluminum film is resolved by the use of a heat-sealing film which ensures the adhesion between the basic insulating layer and the thin aluminum film. This heat-sealing film makes it possible to obtain a gluing surface having a considerably reduced permeability in relation to that obtained by gluing spots. Preferably, this heat-sealing film is laid directly onto a decorative painted sheet-glue-aluminum complex. The heat-sealing film is activated by a heating table or any other equivalent means. This heat-sealing film is for example a polyethylene film having a basic weight below 40 g/m$^2$ which is sufficient to obtain a solid adhesion. A heat-sealing film of such a small thickness is not in itself entirely impermeable to steam but on the other hand by associating it with the aluminum film a sufficiently impermeable and complete barrier is obtained.

The smoother the surface of the insulating layer, the greater will be the strength of the adhesion between the heat-sealing film and the mineral fiber, particularly glass fiber, insulating layer. This smooth character may be obtained right at the stage at which the insulating mat is produced. Thus, it is possible to provide the insulating layer with a surfacing layer, preferably consisting of a glass fiber sheet—for example of textile glass fibers—on which the glass fiber insulating fibers are directly gathered at the moment the insulating mat is produced. The final adhesion between this surfacing sheet and the layer of insulating fibers is thus achieved by means of the bonding resin present between it and the fibers. The surfacing sheet is preferably obtained by a paper making technique which gives it a fairly constant thickness over its entire surface. Furthermore, it improves the mechanical strength of the panel which is rigidified without any need for its density and therefore its weight to be increased.

As indicated previously, the decorative appearance of the panel is due to the external painted sheet. Preferably, a first coat of paint is applied uniformly, e.g., a coat of, for instance, 50 g/m$^2$, which serves as an undercoat, after which printing rollers apply a second coat 5 possibly of a different color, which provides the decorative pattern. The undercoat of paint serves as a masking, and eliminates the brilliant appearance and reflections from the aluminized coating disposed between the porous sheet which is thus partially transparent.

The panel, according to the invention, does not attract a lot of dust, constitutes a barrier to steam to a degree sufficient that the panel can be used as a false ceiling, even under the final level of a building, with no risk of condensation, while at the same time, ensuring quality, sound and heat insulation.

What is claimed is:

1. A heat and sound insulating panel, comprising:

(1) an insulating layer having at least first and second major surfaces, and comprised of mineral fibers bonded together, by a synthetic resin, (2) a heat-sealing film of low steam permeability adhered to the first major surface of the said insulating layer, (3) a film of aluminum adhered to said heat-sealing film opposite said insulating layer, and of a thickness no greater than 9 microns, and (4) a layer comprised of a sheet of glass fibers adhered to said film of aluminum opposite said heat-sealing film.

2. The panel of claim 1, wherein said heat-sealing film is comprised of polyethylene.

3. The panel of claim 1, wherein said mineral fibers are comprised of glass.

4. The panel of claim 1, further comprising a separate substantially smooth comprised of glass fibers layer between said first insulating layer surface and said heat-sealing film.

5. The panel of claim 1, wherein said insulating layer of mineral fibers is comprised of glass fibers and has a weight of between 700–2500 g/m$^2$.

6. The panel of claim 1, wherein the layer comprised of glass fibers is provided with an undercoat of paint, and a decorative layer provided thereon.

* * * * *